US008047118B1

(12) United States Patent
Teetzel et al.

(10) Patent No.: US 8,047,118 B1
(45) Date of Patent: Nov. 1, 2011

(54) INTEGRATED LASER RANGE FINDER AND SIGHTING ASSEMBLY

(75) Inventors: James W. Teetzel, York, ME (US); Gary M. Lemire, Lee, NH (US)

(73) Assignee: Wilcox Industries Corp., Newington, NH (US)

( * ) Notice: Subject to any disclaimer, the term of this patent is extended or adjusted under 35 U.S.C. 154(b) by 328 days.

(21) Appl. No.: 12/185,540

(22) Filed: Aug. 4, 2008

Related U.S. Application Data

(60) Provisional application No. 60/953,642, filed on Aug. 2, 2007, provisional application No. 61/081,972, filed on Jul. 18, 2008.

(51) Int. Cl.
*F41G 1/473* (2006.01)
*F41G 3/06* (2006.01)
*G06G 7/80* (2006.01)

(52) U.S. Cl. ..... 89/41.17; 235/414

(58) Field of Classification Search ..... 42/114, 42/115, 117, 142; 89/41.17; 235/414, 417, 235/404

See application file for complete search history.

(56) References Cited

U.S. PATENT DOCUMENTS 4,214,372 A * 7/1980 Rusbach ..... 42/138
4,787,291 A * 11/1988 Frohock, Jr. ..... 89/41.22
4,965,439 A * 10/1990 Moore ..... 235/404
5,052,801 A * 10/1991 Downes et al. ..... 356/153
5,386,308 A * 1/1995 Michel et al. ..... 349/11
5,555,662 A 9/1996 Teetzel
5,659,965 A * 8/1997 Thibodeau et al. ..... 42/126
5,669,174 A 9/1997 Teetzel
5,711,104 A * 1/1998 Schmitz ..... 42/111
5,824,942 A * 10/1998 Mladjan et al. ..... 89/41.17
5,834,676 A * 11/1998 Elliott ..... 89/41.05
5,903,996 A * 5/1999 Morley ..... 42/115
5,922,987 A * 7/1999 Hoffman et al. ..... 89/37.11
5,966,825 A * 10/1999 Biemont ..... 42/136
6,418,657 B1 * 7/2002 Brown ..... 42/124
6,568,118 B1 5/2003 Teetzel
6,899,539 B1 * 5/2005 Stallman et al. ..... 434/11
7,332,682 B2 * 2/2008 Kim ..... 200/18
7,490,430 B2 * 2/2009 Staley, III ..... 42/111
7,621,065 B2 * 11/2009 Gablowski ..... 42/135
2005/0252062 A1 * 11/2005 Scrogin et al. ..... 42/119
2006/0272194 A1 * 12/2006 Guettner ..... 42/122

OTHER PUBLICATIONS

Author Unknown, AR-15-Type Rifle Exploded Diagram, Date Unknown, Published on the internet, "http://www.ar15products.net/att3.gif" converted to Adobe pdf file, 2 pages in length.*

* cited by examiner

*Primary Examiner* — Bret Hayes
(74) *Attorney, Agent, or Firm* — McLane, Graf, Raulerson & Middleton, Professional Association

(57) ABSTRACT

An integrated laser range finder and sighting assembly includes a range finder for determining a distance to a target and an onboard ballistics computer for calculating a trajectory and automatically rotating a pointing laser to the proper angle for aligning with the target for lobbing of a grenade.

15 Claims, 12 Drawing Sheets

INTEGRATED LASER RANGE FINDER AND SIGHTING ASSEMBLY

CROSS-REFERENCE TO RELATED APPLICATIONS

This application claims the benefit of priority under 35 U.S.C. §119(e) to U.S. provisional application No. 60/953,642 filed Aug. 2, 2007, and U.S. provisional application No. 61/081,972, filed Jul. 18, 2008. Each of the aforementioned provisional applications is incorporated herein by reference in its entirety.

BACKGROUND

This application discloses further improvements on the laser range finding and sighting apparatuses disclosed in the aforementioned U.S. provisional patent application Nos. 60/953,642 and 61/081,972, the laser range finding apparatuses disclosed in U.S. Pat. Nos. 5,555,662 and 5,669,174, and the grenade launcher sighting assembly disclosed in U.S. Pat. No. 6,568,118. Each of the aforementioned patents is incorporated herein by reference in its entirety.

SUMMARY

The present disclosure relates to an integrated rangefinder and sight with ballistic computer for use with grenade launchers such as stand alone grenade launchers or grenade launchers that are attached to assault rifles such as an M-16 assault rifle, M-4 Carbine, or the like. In further embodiments, a second, auxiliary sight, such as a reflex sight may be provided.

BRIEF DESCRIPTION OF DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1:
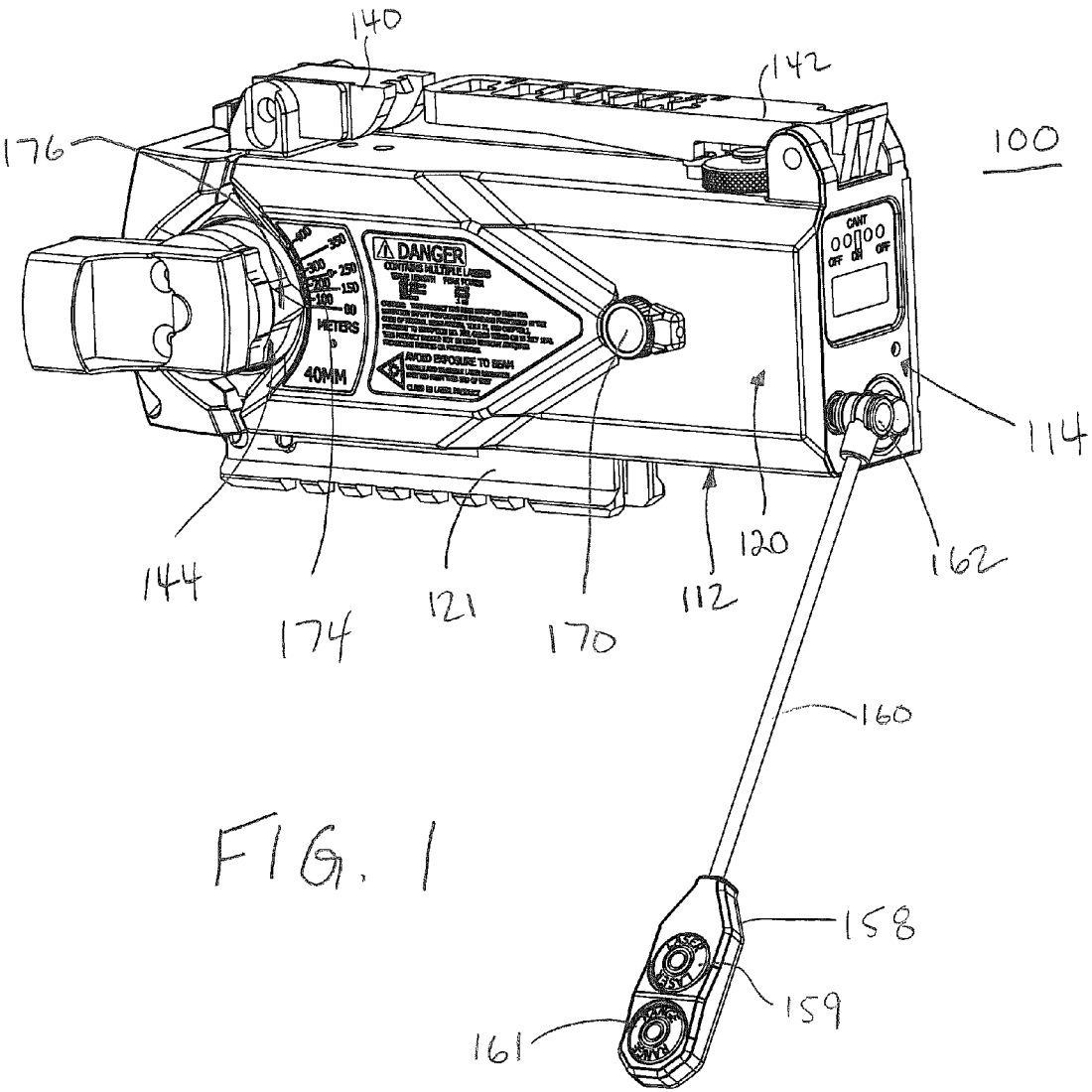
FIG. 1 is a pictorial view, taken generally from the left side, of a first exemplary embodiment of a sight unit herein.

Referring to the drawings wherein like reference numerals refer to like or analogous components throughout the several views, an exemplary sight module 100 is shown, which includes a housing 112. As used herein, terms denoting direction or orientation, such as left, right, front, rear, upper, lower, horizontal, vertical, etc., are taken from the perspective from an operator facing a rear side 114 of the unit 100 when the unit is mounted on a weapon, such as directly to a grenade launcher capable of use in stand alone fashion or to a firearm such as a military rifle carrying a grenade launcher module. A left side 120 of the unit 100 is disposed opposite a right side 118 thereof. Opposite upper and lower surfaces 122 and 124, respectively, are bounded by and extend generally vertically between the front, rear, left and right surfaces.

Figure 2:
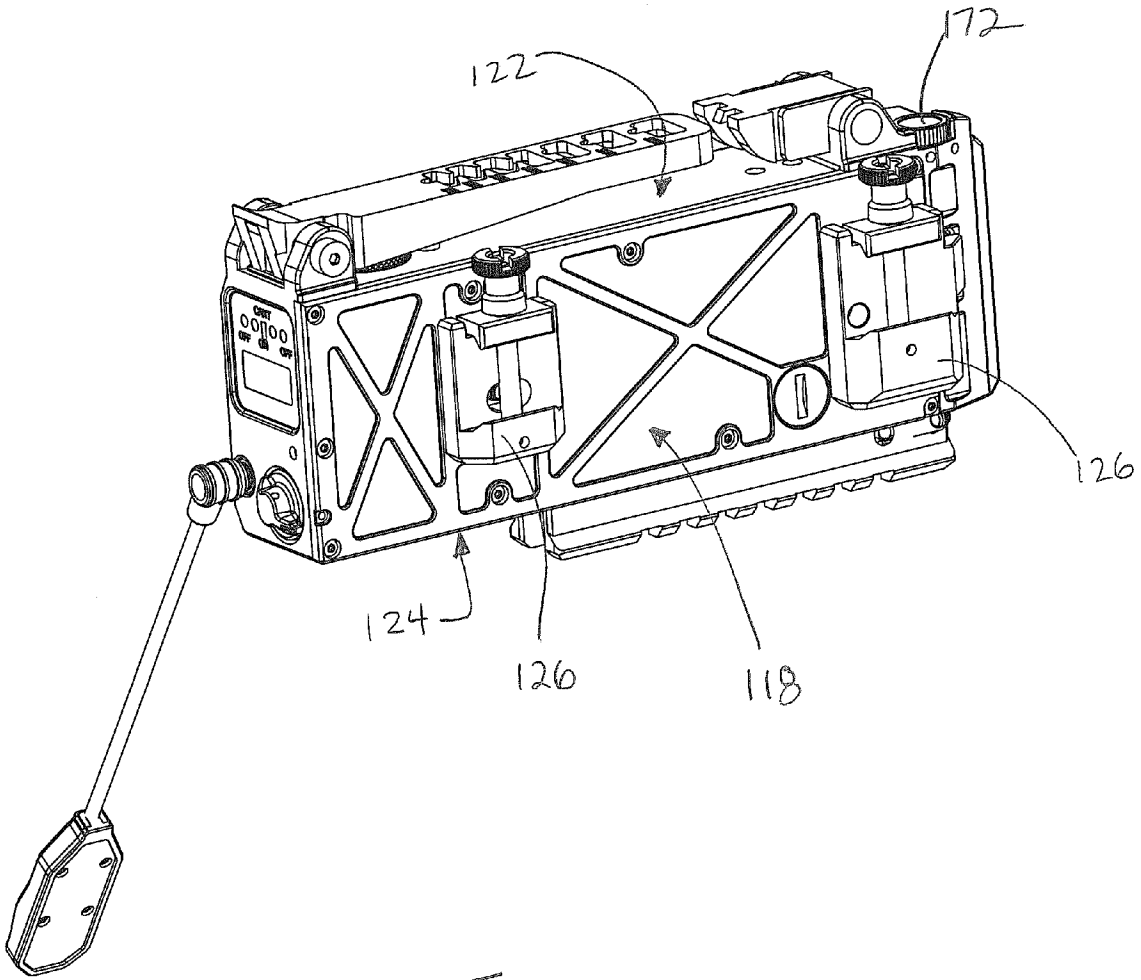
FIG. 2 is a pictorial view, taken generally from the right side, of the embodiment shown in FIG. 1.
Figure 3:
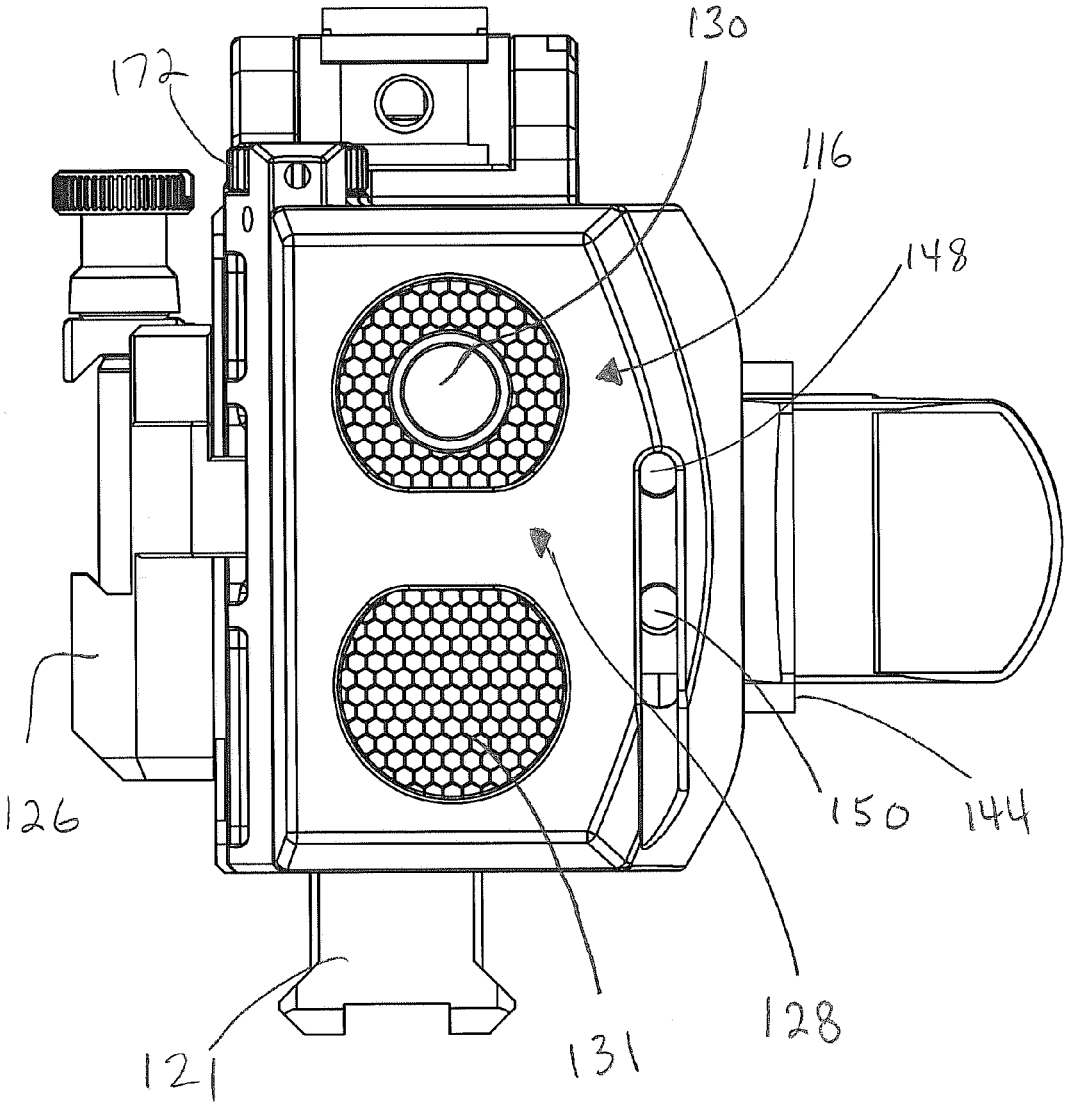
FIGS. 3 and 4 are front elevational views of the embodiment shown in FIG. 1, with the bottom Picatinny rail section shown attached and detached, respectively.
Figure 4:
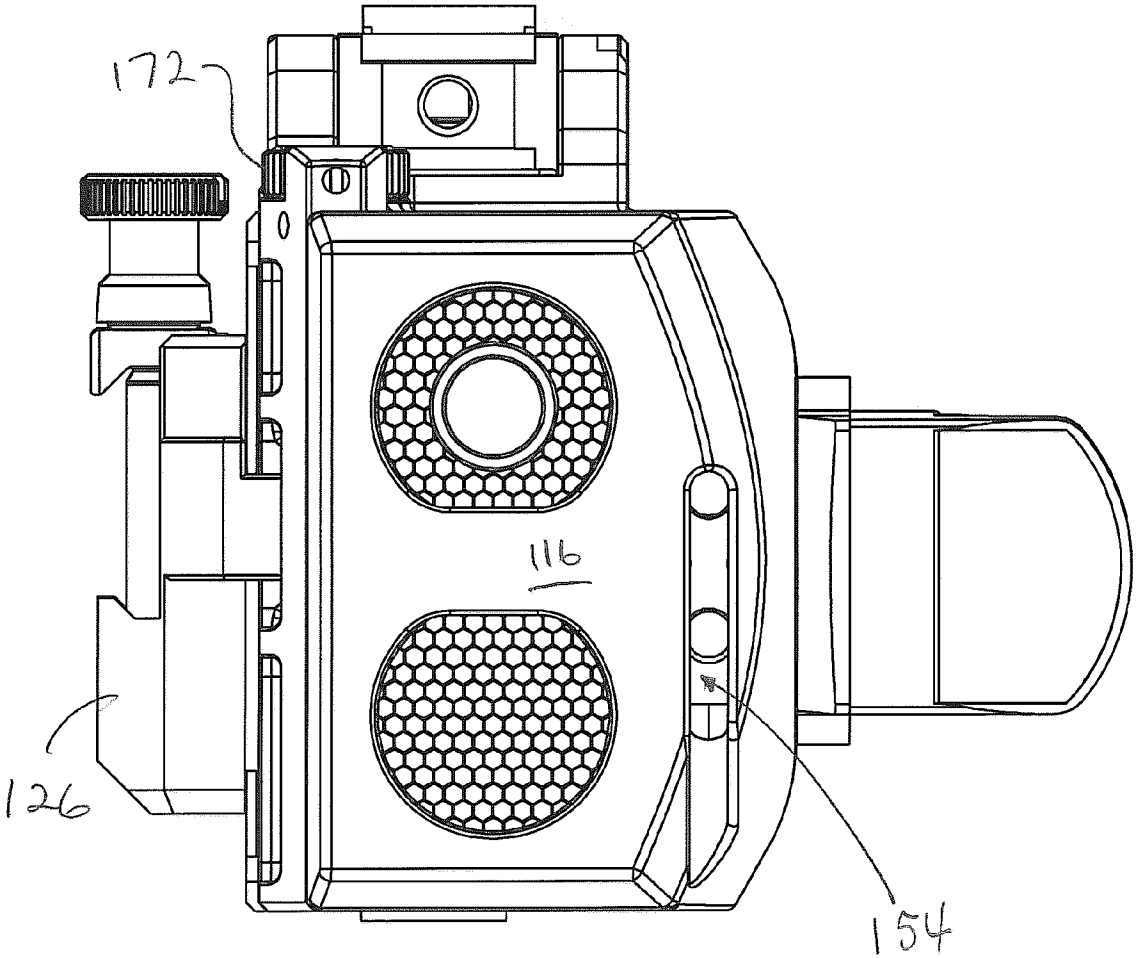
Figure 5:
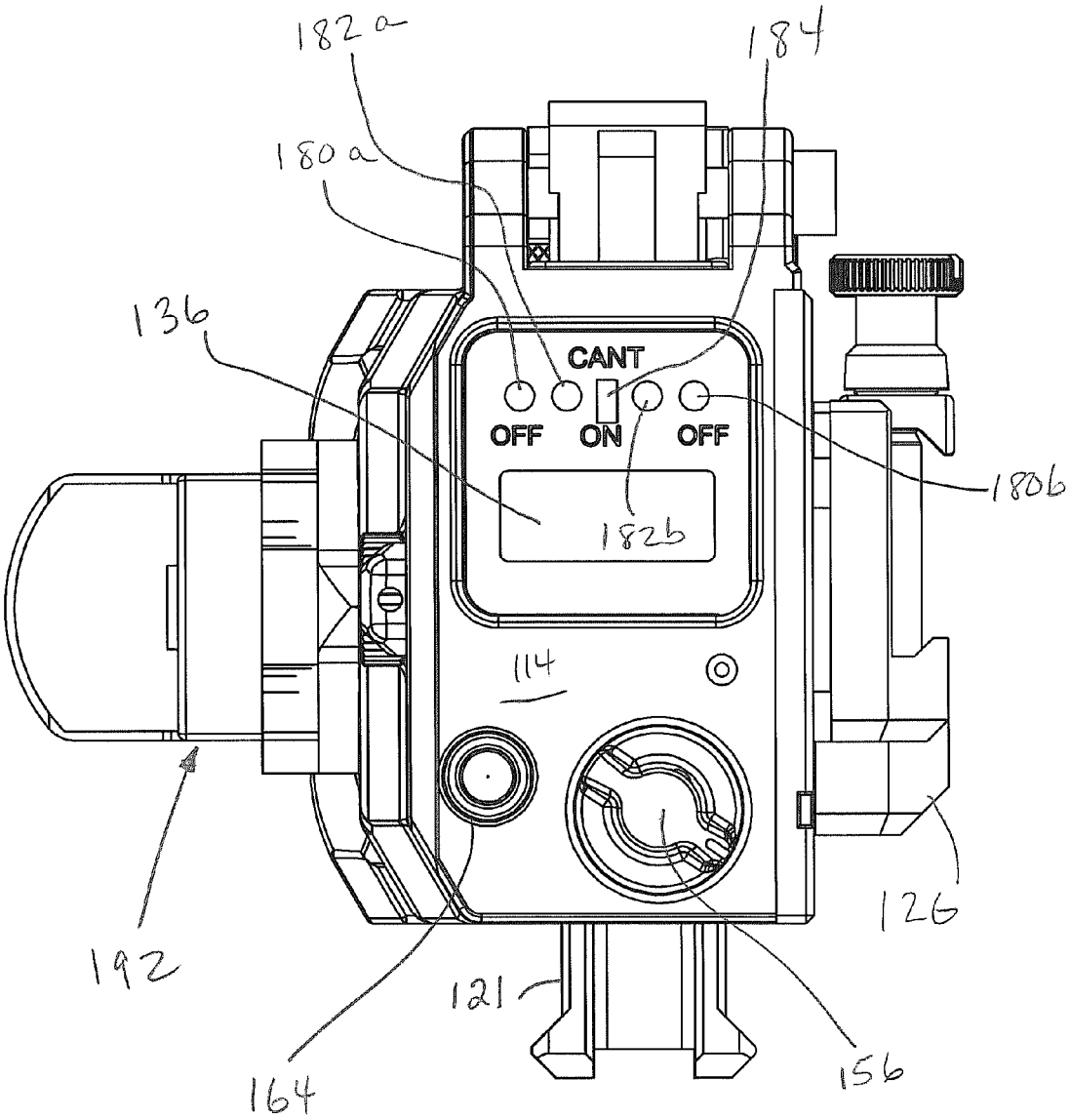
FIG. 5 is rear elevational view of the embodiment shown in FIG. 1.
Figure 6:
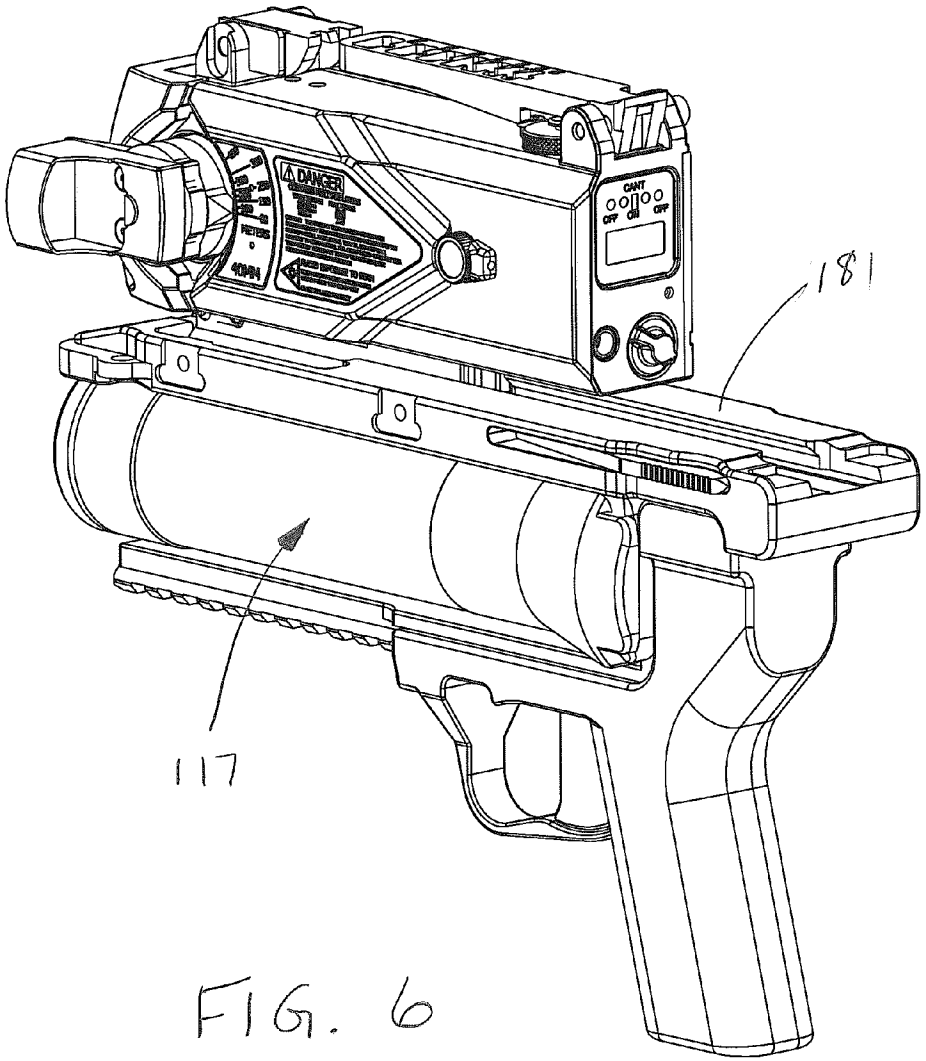
FIG. 6 is a pictorial view of the embodiment shown in FIG. 1, shown attached directly to a grenade launcher that is adapted to be used as a stand alone unit.
Figure 7:
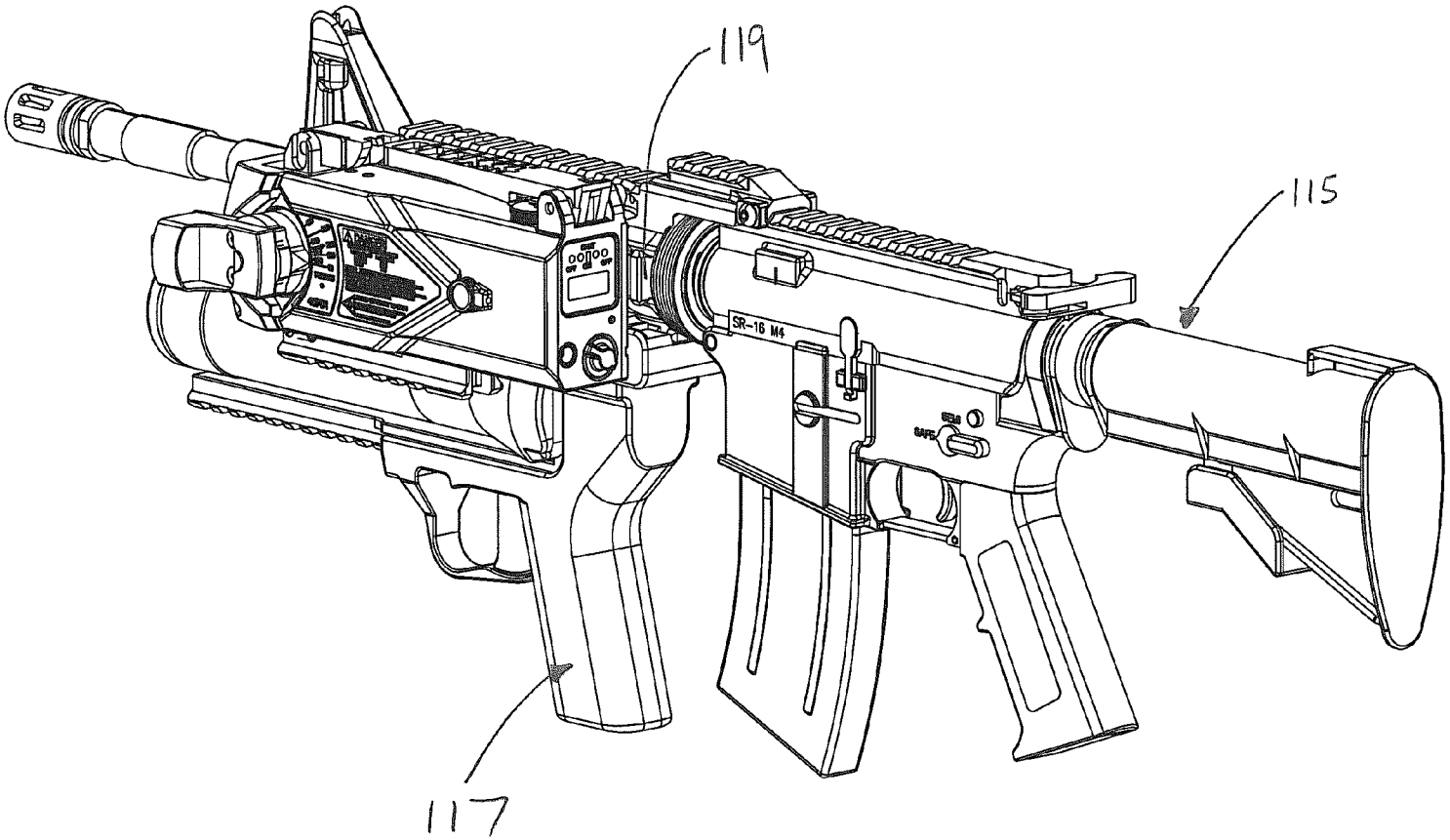
FIG. 7 is a pictorial view of the embodiment shown in FIG. 1, shown attached to a left side Picatinny interface of a military rifle, and wherein the grenade launcher is attached to a bottom rail interface of the military rifle.

In operation, the user views the rear side 114 of the unit 100. A front side 116, as best seen in FIGS. 3 and 4, is opposite the rear surface 114 and faces away from the user during operation, toward the selected target. The right side 118 (see FIG. 2), is adapted to be attached to the left side of a weapon 115, such as a military rifle having a grenade launcher 117 attached thereto (see FIG. 7). It will be recognized that other mounting configurations are possible.

The right side 118 of the unit 100 includes first and second rail grabbers 126. In the depicted embodiment, the rail grabbers 126 are adapted to fasten the unit 100 to a conventional Picatinny mounting rail 119 on the left side of the weapon 115. It will be recognized that the rail grabbers 126 could be adapted for use with other rail or accessory mounting interfaces. The grenade launcher 117 may be an XM320 grenade launcher module or the like.

Alternatively, a section of Picatinny mounting rail 121 (or other interface type if desired) may be removably attached to the lower surface 124 of the unit 100, which allows the unit 100 to be removably attached to a complimentary rail interface member 181 provided on the upper surface of the grenade launcher 117, e.g., where the grenade launcher 117 is capable of being used as a stand alone unit.

Referring now to the front side 116, the unit 100 includes an optical range finder 128 including an optical transmitter 130 including an optical source, such as a laser and preferably an infrared (IR) laser source, and an optical receiver 131. In operation, the distance to a target is determined by measuring the time interval between the emission of an optical signal by the transmitter 128 to the target and detection of the reflected signal by the receiver 131. The range finder assembly 128 may be a commercially available unit, such as a rangefinder unit available, for example, from Vectronix Inc. of Leesburg, Va.

The front side 116 of the housing 112 includes a cover 137, and an anti-glare member formed of a honeycomb or collimating material 139 to prevent off-angle reflections from the range finder components. Optical filters 141 and 143, which permit passage of the wavelength of the optical source 131, may be provided in the apertures 171 and 173 and may include a sealing ring or gasket thereabout to prevent entry of moisture and environmental contamination into the interior of the housing 112 through the apertures 171, 173. One or more lenses or other optical elements 153 may be aligned with the optical axis of the range finding laser 130.

Figure 11:
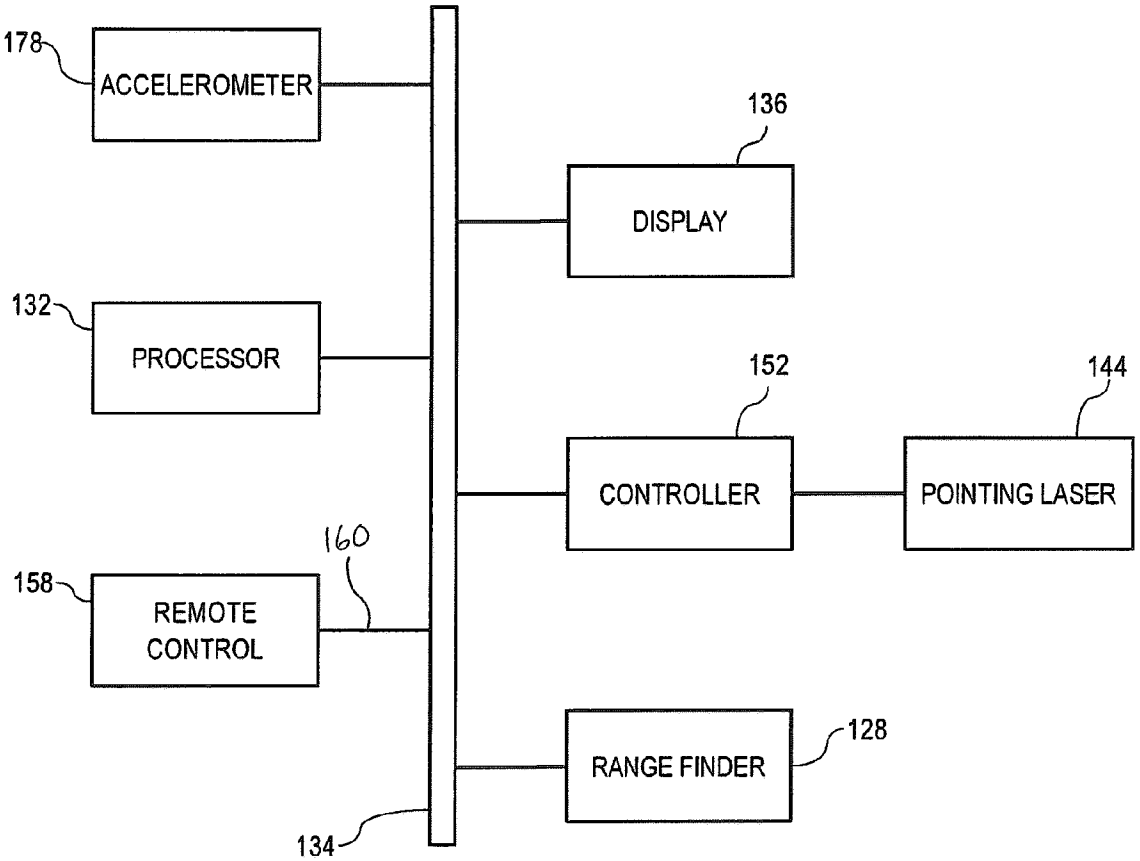
FIG. 11 is a functional block diagram of an exemplary processing system of the sight units herein.

As best seen in FIG. 11, the range calculation is performed by an onboard processor, microprocessor, microcontroller, or the like 132, which may be coupled to the rangefinder 128 and other on-board components as described herein via a data bus 134. The processor 132 is provided on a main processing board 163. The processor 132 is also electrically connected to a programming port 165 for programming the processor with software instructions to perform the ballistic computations and other functions of the unit 100 and/or for storing software instructions in a memory coupled to the processor 132. The port 165 is accessible through an opening 167 in a rear housing cover 175. The opening 167 is covered with a removable cover 169, which may include an O-ring or the like to prevent entry of moisture or other external contaminants into the housing 112.

The distance to the target as determined by the rangefinder 128 may be output to a human viewable display 136 located on the rear facing surface 114 via the data bus 134. The display unit 136 may be any display type and is preferably a light emitting diode (LED) display or liquid crystal display (LCD). Advantageously, the display may be a seven-segment LED or LCD display of a type used to display alphanumeric characters, and may be a backlit LCD display.

A daytime or ladder sight system includes a front sight 140 and a rear leaf or ladder sight 142, which are pivotally collapsible when not in use, which are provided on the upper surface 122 of the housing 112. The daytime sights may be used in the conventional fashion and may advantageously be employed in the event that the unit 100 malfunctions. The daytime sight is also advantageously employed if the laser spot created by laser pointer sight is not readily visible, e.g., under bright light conditions, especially for embodiments not including the optional auxiliary sight 192.

In the depicted preferred embodiment, a pointing laser assembly 144 includes a rotatable knob 146 portion, an inner housing portion 147, and a laser housing front cover 149, which house a first pointing laser 148 and a second pointing laser 150. The laser housing front cover 149 includes apertures 151 aligned with each of the lasers 148 and 150. The pointing laser assembly 144 is coupled to a controller 152, such as a servomotor or drive motor for controlling the degree of rotation of the laser assembly 144 relative to the axis of the barrel of the grenade launcher. The controller 152 may use gears and/or other conventional mechanical linkages to rotate the laser assembly 144 as would be understood by persons skilled in the art. In the depicted preferred embodiment, a drive motor 111 rotates a drive shaft 113 which is coupled to a shaft 135 to rotate the laser assembly 144 to a desired angular position. A key 123 rotatably couples the controller 152 to the drive shaft 113.

Figure 8:
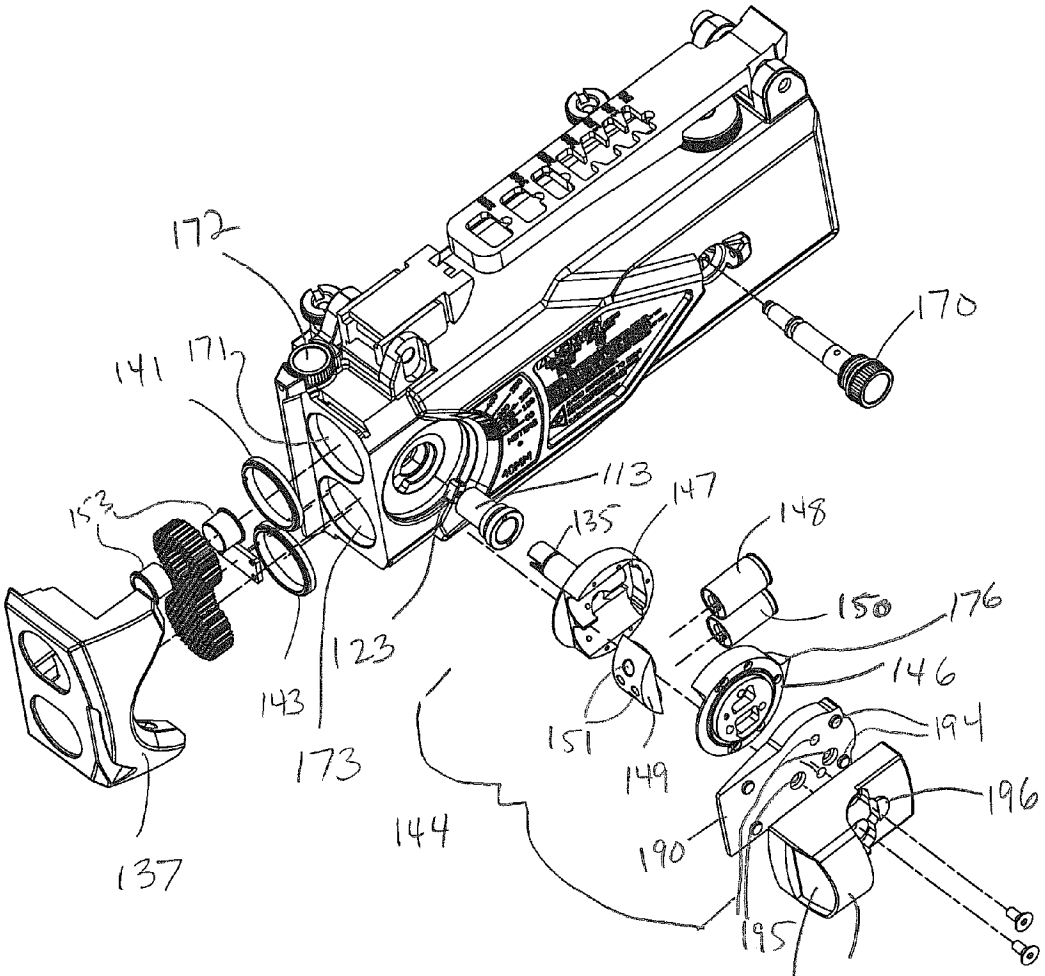
FIG. 8 is a partially exploded pictorial view, taken generally from above and to the left, of the embodiment shown in FIG. 1.
Figure 9:
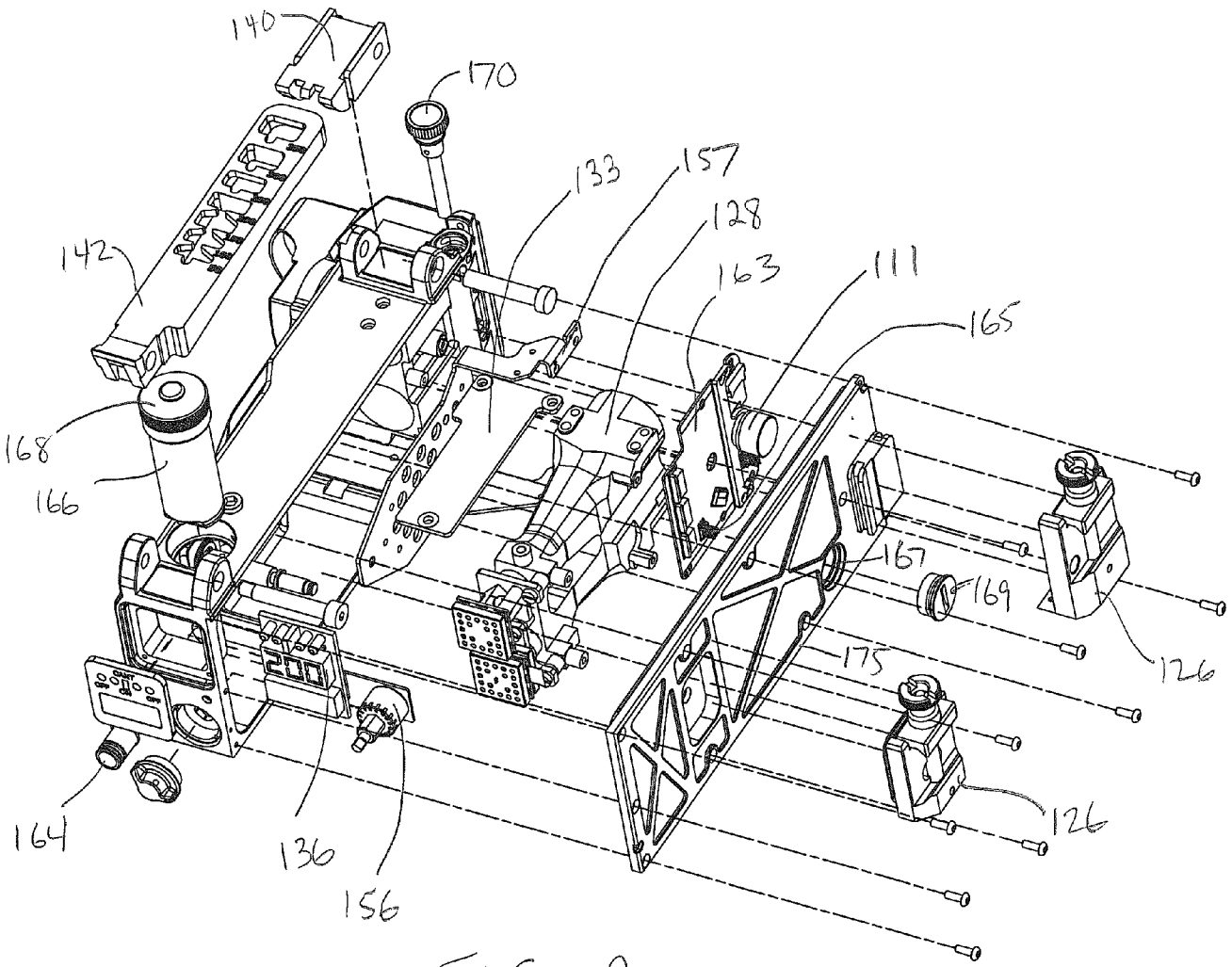
FIG. 9 is a partially exploded view, taken generally from above and to the right, of the embodiment shown in FIG. 1

Although the use of only a single pointing laser is contemplated, a plurality of user selectable pointing lasers may be provided, e.g., so that lasers having different wavelengths may be selectively employed. The depicted preferred embodiment includes first and second pointing lasers 148, 150. For example, the pointing laser 148 may be an infrared laser for use with night vision goggles and the laser 150 may be visible laser for viewing with the naked eye. The pointing laser to be used to sight onto a specific target may be user selectable as described below. The lasers 148 and 150 are transmitted through an elongate vertical slot 154 in the front housing cover 137. Although the pointer lasers 148 and 150 are displaced on the laser assembly 144, as best seen in FIG. 8, they are preferably aligned and rotate together in parallel fashion so that the beams emitted by each are parallel to each other.

A power switch 156 on the rear surface 114 is provided to power the unit on and off and preferably is a rotary switch to allow the selection of the pointing laser mode. For example, in the depicted preferred embodiment wherein multiple pointing lasers are provided, the switch 156 could be rotatable to select between OFF, IR, and VIS positions, wherein the IR position will select the IR pointing laser 148 and the VIS position will select the visible laser 150. Alternatively, the switch 156 could also be used to select a power setting, e.g., high or low power, for the selected pointing laser, e.g., OFF, IR LOW, IR HIGH, VIS. LOW, and VIS. HIGH positions. Indicia (not shown) representative of the mode corresponding to each rotational position of the switch 156 may be provided on the housing 112. An option to deactivate both pointing lasers may also be provided for use of the unit with an alternative or auxiliary sighting device 192, as described below. other switching configurations are also contemplated.

Other functions may also be controlled via the rotary switch 156 and/or the control pad 158. For example, a display setting, e.g., DIS, may be provided for the selector 156 which allows the buttons 159 and/or 161 to control display functions, such as brightness in the case of an LED display, or brightness and/or contrast in the case of an LCD display.

Figure 10:
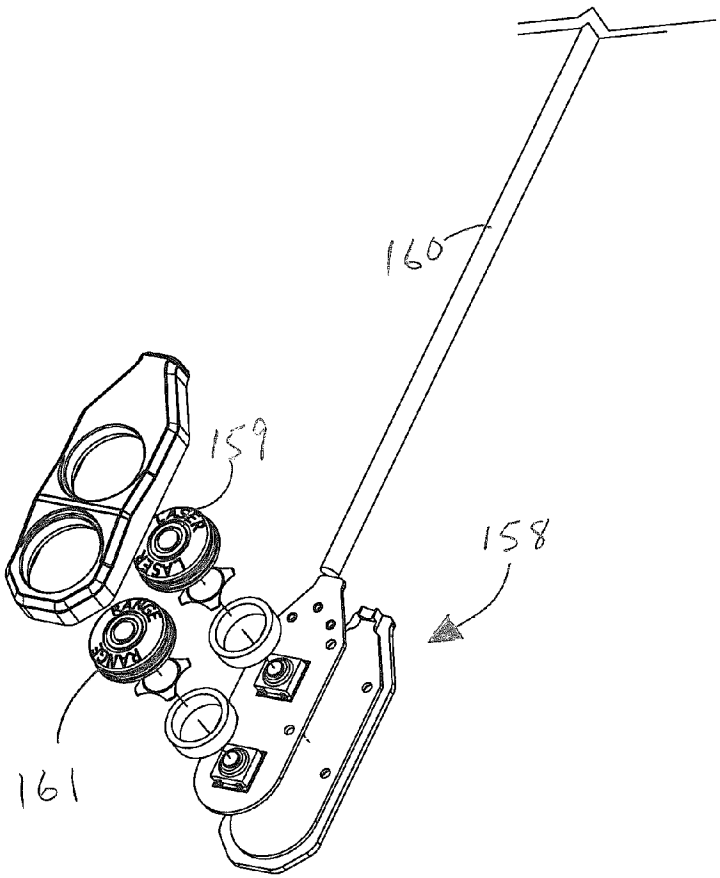
FIG. 10 is an exploded pictorial view of the remote control unit.

Operation of the unit may be controlled using the control pad 158 including, for example, a first switch 159 for controlling the pointing lasers 148, 150 and a second switch 161 for controlling the range finder 128. The control pad 158 is coupled to the unit 100, e.g., via a cable 160 and plug connector 162 engaging a receptacle 164 on the rearward facing surface 114 of the unit, which, in turn, is coupled to the processor 132 via the data bus 134. An exploded view of the control pad 158 appears in FIG. 10.

Power is supplied to the processor 132, the display 136, the range finder 128, the pointing lasers 148, 150, and the controller 152 via one or more batteries or battery packs, e.g., one or more lithium batteries, housed in a battery compartment or tube 166, e.g., having a removable cover 168.

A windage knob 170 is disposed on the left side 120 of the unit to provide a horizontal bore sighting adjustment for bore sighting the pointing lasers 148, 150 to the grenade launcher. An elevation knob 172 is provided on the upper surface 122 of the unit to provide a vertical bore sighting adjustment of the pointing lasers to the grenade launcher.

In an exemplary mode of operation, the user powers the unit on by rotating the rotary switch 156 to a desired position, which also selects which of the pointing lasers 148, 150 will be actuated by the button 159 and, if a power selection option is provided, selects the power setting for the selected pointing laser. An indication that the unit has been powered on may be shown on the display, for example, by displaying three dashes or horizontal lines on the display 136. In the preferred embodiment, the angular orientation of the pointing laser assembly relative to the axis of the range finder laser 130 is determined and, if it is not at the zero position, it is automatically returned to the zero position.

The button 159 may operate as a toggle switch to toggle the selected one of the pointing lasers 148, 150 on and off or, alternatively, the button 159 may function as a momentary contact switch, e.g., to activate the selected pointing laser when the switch is depressed and to deactuate the selected pointing laser when the switch is released.

In a preferred embodiment, the time of the button press or button down events for the button 159 are monitored by the processor 132. If the time of a button down event is less than some predetermined value, such as one-half second, the switch 159 functions as a momentary contact switch, actuating the laser only when the button depressed and deactivating the laser when the button is released. If the user holds the button down for a period of time that is greater than the preselected threshold, then the button 159 will function as a toggle switch and the pointing laser will remain on after the button is released. The user may then press the button 159 again to deactivate the pointing laser.

The range finder 128 is actuated by depressing the button 161. Preferably, the state of the button switch 161 is monitored and the range finder is not actuated until the button switch 161 is held down for some first preselected period of time, e.g., one-half second, before being released. Upon actuation of the range finder, the distance to the target is determined and displayed on the display 136.

The user then has the ability to accept the displayed distance by holding the button 161 for some second preselected period of time, e.g., for two seconds. Alternatively, if the user does not want to accept the displayed range, the button 161 is depressed for a period of time that is less than the second preselected period of time, at which point the range finding process may be repeated. This gives the operator an opportunity to confirm that the distance calculated by the range finder 128 is consistent with a distance estimate of the operator and, if necessary, to perform the range finding operation again.

If the user accepts the displayed range, the distance calculated by the range finder function is used by a ballistics computer functionality or module of the processor 132 to calculate the appropriate angle of trajectory of the grenade launcher relative to the line of sight between the user and the target. The ballistics computation may be made based on the distance to the target and, optionally, other factors, such as barometric pressure, temperature, humidity, and so forth as would be understood by persons skilled in the art. The ballistics computation may also take into account the vertical displacement of the pointing lasers 148, 150, depending on which pointing laser is selected. In a preferred embodiment, barometric pressure, temperature, and humidity sensors may be provided on the unit and coupled to the processor 132 via the data bus 134.

Once the trajectory is calculated, the processor 132 operates the controller 152 to rotate the pointing laser assembly 144 so that the relative angle between the path of the selected one of the lasers 148 and 150 and the bore of the barrel of the grenade launcher are such that aligning the operative one of the lasers 148 and 150 with the target will cause the grenade launcher to be positioned at the proper angle for firing the grenade. Also, when the displayed range is accepted by the operator, an anti-cant indicator 178 is activated to assist the user in maintaining the grenade launcher 117 in a substantially horizontal position relative to the optical axis of the pointing laser sight assembly when aligning the pointing laser on the target and firing the grenade.

Once the pointing laser is aligned with the target and the shot is fired (or if it is otherwise desired to reset the unit), the user may reset the unit by depressing the range button 161 (and preferably by holding it for some predetermined period of time such as one-half second) at which point the display screen resets (e.g., displays the three-horizontal pattern or other indicia to indicate that the unit is powered on) and returns the laser assembly to the zero position.

In certain embodiments, the processing unit 132 calculates the distance and displays the actual distance on the display unit 136. Alternatively, the user may have the option of displaying the effective "ballistics distance" which takes into account any difference in elevation between the user and the target. The inclination along the line of sight between the operator and the target may be determined using an onboard accelerometer or inclinometer 133, which may be a two-axis accelerometer for sensing inclination of the unit 100 along the front-to-back axis of the unit for calculating the ballistics distance and along the side-to-side axis of the unit for use with the cant detection function of the unit 100. The accelerometer 133 is mounted to an anti-torsion plate 157 housed within the housing 112.

In a further aspect, a manual override capability is provided. Distance indicia 174 may be provided adjacent the knob 146 and the operator may manually rotate the knob so that a pointer 176 on the knob 146 is aligned to select a particular distance (e.g., a distance to the target as determined by an alternate distance estimation or calculation technique). In this manner, the angle of the pointing laser assembly 144 may be manually rotated until the pointer is aligned with a selected distance to provide an appropriate trajectory angle of the grenade launcher based on the selected distance. The display of the effective ballistics distance is advantageous when there is an elevation difference between the user and the target and the user intends to use the ladder sight or intends to manually rotate the laser assembly to a desired position as described above.

The anti-cant indicator includes a sensor, such as the accelerometer 178 to determine the degree side-to-side of rotation of the unit 100 and provide a visual indication when the unit is appropriately positioned, e.g., substantially horizontal relative to the horizon. In the depicted embodiment, a horizontal array of light-emitting diodes (LEDs) 180*a*, 180*b*, 182*a*, 182*b*, and 184 are provided to provide a visual indication of the degree of cant. For example, one of the outermost LEDs 180*a* and 180*b* may be actuated by the processor when the degree of cant to the left and right, respectively, is greater than some first preselected cant angle, e.g., 5 degrees. One of the intermediate set of LEDs 182*a* and 182*b* may be actuated when the cant angle, to the left and right respectively, is between the first preselected cant angle and a second preselected cant angle, e.g., between 2.5 degrees and 5 degrees. The central LED 184 is actuated when the cant angle is less than the first preselected cant angle, e.g., less than 2.5 degrees, indicating that the unit is in proper position for firing. The LEDs 180-184 may also be color coded, for example, the LEDs 180*a* and 180*b* may be red, LEDs 182*a* and 182*b* may be yellow, and LED 184 may be green, with green indicating the proper position for firing and with yellow and red representing increasing degrees of cant.

In some instances, it may be undesirable to use the pointing lasers 148, 150 to sight onto the target. For example, the laser beam emitted by the lasers 148 and 150 may be visible to others, thereby revealing the position of the operator and potentially compromising the operator's safety. Also, the user, in aligning the pointing laser sight 148, 150 with the target may have difficulty seeing the laser under bright light, e.g., daylight, conditions. In the depicted preferred embodiment, the knob 146 of the laser pointing assembly 144 includes an alternative sighting device 192. In this manner, the alternative sight 192 may be sighted onto the selected target instead of the pointing laser sight to set the trajectory angle of the grenade launcher. While it is contemplated that the auxiliary sight could be a secondary laser sight, the present development can advantageously employ an alternative sight that does not transmit a beam that can potentially reveal the user's position, and/or which can be more readily aligned with the target in daylight or other bright light conditions. Most preferably, the auxiliary sight 192 is a reflex sight.

In the depicted embodiment, the laser knob or cover 146 includes a plate 190 which is adapted to receive the reflex sight 192. The reflex sight 192 may be a commercially available reflex or red dot sight, e.g., which are commercially available from JPOINT, PRIDEFOWLER, DOCTER, and others. The adapter plate 190 may have features such as protrusions 194, screw holes 195, etc., which are complimentary with the engaging surface of the reflex sight 192 and/or the knob member 146. In this manner, the laser assembly 144 may be adapted for use with a particular desired sight by providing a complimentary adapter plate 190. Alternatively, the reflex sight could be integrally formed with the laser assembly 144.

The depicted reflex sight 192 includes a reticle laser assembly 196 having a laser that focuses a dot (or other reticle shape) onto a partially reflective lens 198, to visually superimpose the dot on the target when viewed by the user through the lens 198. The reticle laser 196 of the reflex sight 192 will generally include a dedicated power supply, such as a lithium battery. However, an electrical coupling between the reflex sight 192 and the power supply 166 of the unit 100 is also contemplated.

In operation, the user may elect to employ the reflex sight 192 instead of the pointing lasers 148, 150. In operation, the user actuates the laser rangefinder to calculate the distance between the operator and the target. If accepted by the user as detailed above, the processor 132 then uses the distance to calculate the appropriate angle between the line of sight between the operator and the target and the barrel of the grenade launcher and rotates the knob 146 carrying the reflex sight to this angle. The operator may then visually align the dot of the reflex sight 192 on the target when viewed through the lens 198. When the reticle of the reflex sight 192 is visually superimposed on the target as viewed through the lens 198, the grenade launcher will be aligned to provide an appropriate trajectory for the calculated distance and other optional ballistics computation factors.

Although the preferred embodiments herein show a reflex sight 192, it will be recognized that any other type of alternative sight may also be used, such as iron sights, a telescopic sight (e.g., a 2× or 3× optical sight), etc., although it is preferred to use a reflex or other sight which compensates for parallax which occurs when the user's head moves in relation to the sight. Alternatively, the reflex sight 192 could be replaced with a secondary laser sight.

Figure 12:
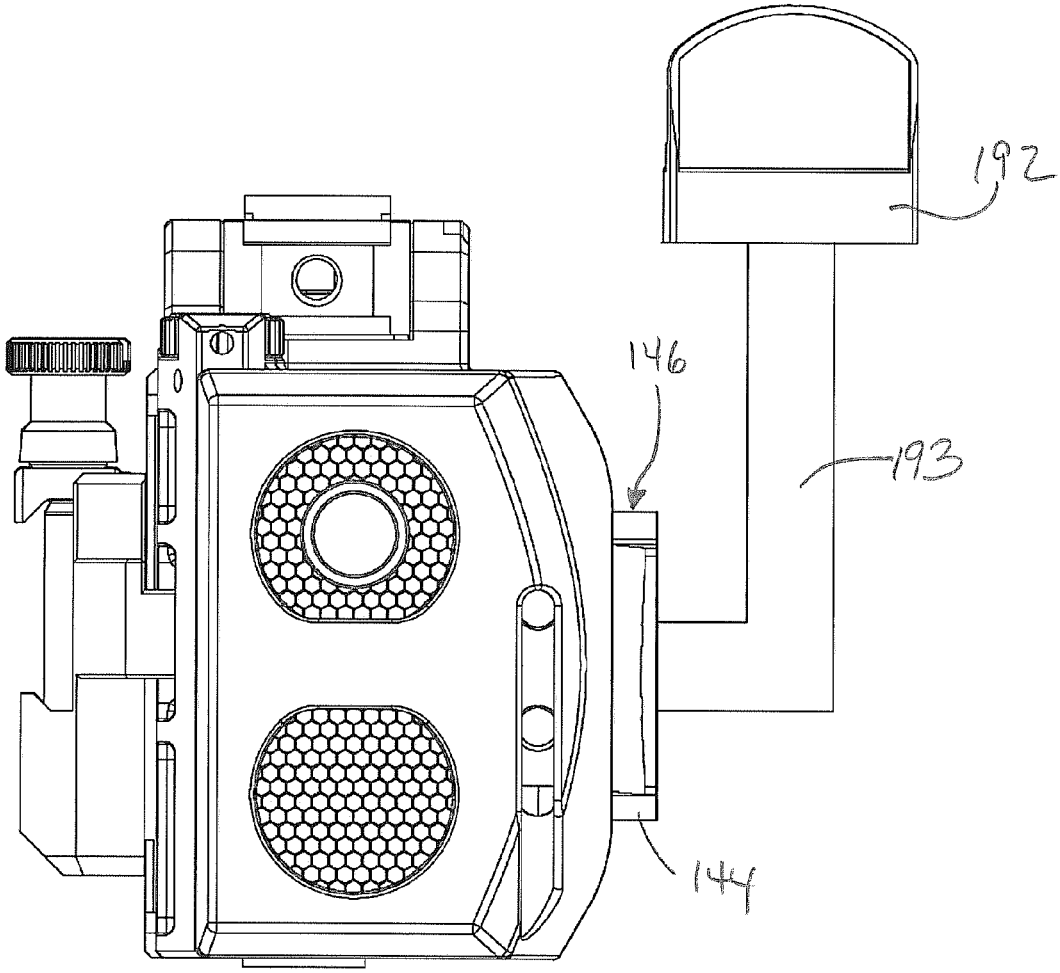
FIG. 12 is a front elevational view of an alternative embodiment wherein the optical axis of the auxiliary sight is vertically offset with respect to the optical axis of the primary laser sight.

Referring now to FIG. 12, there appears a further embodiment, which is as described above, except wherein the reflex sight 192 is attached to an L-shaped arm or bracket 193 to elevate the sight 192 to a position which may more readily be viewed by the user, for example, when the grenade launcher is of a type used in a low or under slung position. The L-shaped arm also allows the auxiliary sight 192 to be mounted in an upright position, as it is conventionally used, rather than the rotated position of the auxiliary sight 192 are it appears in the embodiment of FIG. 1. It will be recognized that any other type of sight such as an iron sight, optical scope, or the like may also be provided on the arm 193 in place of the reflex sight.

The invention has been described with reference to the preferred embodiments. Modifications and alterations will occur to others upon a reading and understanding of the preceding detailed description. It is intended that the invention be construed as including all such modifications and alterations insofar as they come within the scope of the appended claims or the equivalents thereof.

Having thus described the preferred embodiments, the invention is now claimed to be:

1. A combined range finder and sighting apparatus for a weapon having a barrel having an axis, said combined range finder and sighting apparatus comprising:

an optical range finder for calculating a distance to a selected target, said optical range finder including an optical emitter for sending an optical signal to the target and an optical detector for detecting the signal reflected from the target;

a sight assembly rotatably attached to said optical range finder;

a processor for calculating a trajectory angle of the weapon based on the calculated distance to the selected target;

a controller for controlling an angle of rotation of the sight assembly relative to the axis of the barrel of the weapon, such that the barrel of the weapon will be aligned with the trajectory angle when the sight assembly is aligned with the target; and a housing having a plurality of distance indicia thereon;

said sight assembly being manually rotatably attached to said optical range finder, said sight assembly including a pointer, wherein the weapon will fire at a trajectory which corresponds to a distance indicated by a selected one of said distance indicia that is aligned with said pointer when the sight assembly is aligned with the target.

2. The apparatus of claim 1, wherein said sight assembly includes one or both of:

a laser sight including at least one pointing laser for selectively pointing a laser spot at the target; and an auxiliary sight selected from a mechanical sight and an optical sight.

3. The apparatus of claim 2, wherein the auxiliary sight is selected from a reflex sight and a telescopic sight.

4. The apparatus of claim 2, wherein an optical axis of the auxiliary sight is substantially horizontally aligned with an optical axis of the laser sight.

5. The apparatus of claim 2, wherein an optical axis of the auxiliary sight is substantially vertically offset with respect to an optical axis of the laser sight.

6. The apparatus of claim 2, further comprising:

said laser sight including a visible pointing laser and an infrared pointing laser.

7. The apparatus of claim 1, further comprising a rail interface member for attaching said apparatus to a firearm.

8. The apparatus of claim 1, wherein said weapon is a grenade launcher and further comprising a rail interface member for attaching said apparatus directly to the grenade launcher.

9. The apparatus of claim 1, further comprising a display for displaying a numerical indication of the distance to the selected target.

10. The apparatus of claim 9, wherein the numerical indication of the distance to the selected target is selected from one or both of an actual distance to the selected target and an effective ballistic distance to the selected target.

11. The apparatus of claim 1, further comprising a ladder sight system.

12. The apparatus of claim 1, further comprising:

a remote control unit for selectively operating said sight assembly and said optical rangefinder.

13. The apparatus of claim 1, further comprising:

a windage adjustment and an elevation adjustment for boresighting said sight assembly to the weapon.

14. The apparatus of claim 1, further comprising:

an anti-cant indicator for providing a visual indication of the degree of rotation of said apparatus about an optical axis of said sight assembly.

15. The apparatus of claim 1, wherein the weapon is a grenade launcher.

* * * * *